United States Patent [19]

Nerlich

[11] Patent Number: 4,586,424

[45] Date of Patent: May 6, 1986

[54] HYDRAULIC CONTROL ARRANGEMENT

[75] Inventor: Ernst-Günter Nerlich, Essen, Fed. Rep. of Germany

[73] Assignee: Bochumer Eisenhütte Heintzmann GmbH & Co. KG, Bochum, Fed. Rep. of Germany

[21] Appl. No.: 497,738

[22] Filed: May 24, 1983

[30] Foreign Application Priority Data

Jun. 11, 1982 [DE] Fed. Rep. of Germany ..... 3222051

[51] Int. Cl.[4] ..... F01B 25/02

[52] U.S. Cl. ..... 91/6; 91/171; 91/189 R; 405/302

[58] Field of Search ..... 91/6, 170 R, 170 MP, 91/171, 189 R, 193, 517; 405/302

[56] References Cited

U.S. PATENT DOCUMENTS

| | | | |
|---|---|---|---|
| 3,769,881 | 11/1973 | Aoki | 91/171 |
| 4,151,785 | 5/1979 | Koschek | 91/171 |
| 4,192,222 | 3/1980 | Dits | 91/171 |
| 4,309,130 | 1/1982 | Bemmerl | 405/294 |
| 4,343,226 | 8/1982 | Ribeiro de Almeida | 91/171 |
| 4,394,102 | 7/1983 | Batchelder | 414/5 |
| 4,409,884 | 10/1983 | Boehringer | 91/171 |

*Primary Examiner*—Abraham Hershkovitz
*Attorney, Agent, or Firm*—Michael J. Striker

[57] ABSTRACT

A hydraulic control arrangement for providing synchronism of a return cylinder between a face conveyor and a support, has a pushing cylinder which displaces the support transverse to a face, a control valve, a control cylinder influencing loading of the pushing cylinder via the control valve, and a control column provided between the return cylinder and the control cylinder and composed of a working fluid.

9 Claims, 1 Drawing Figure

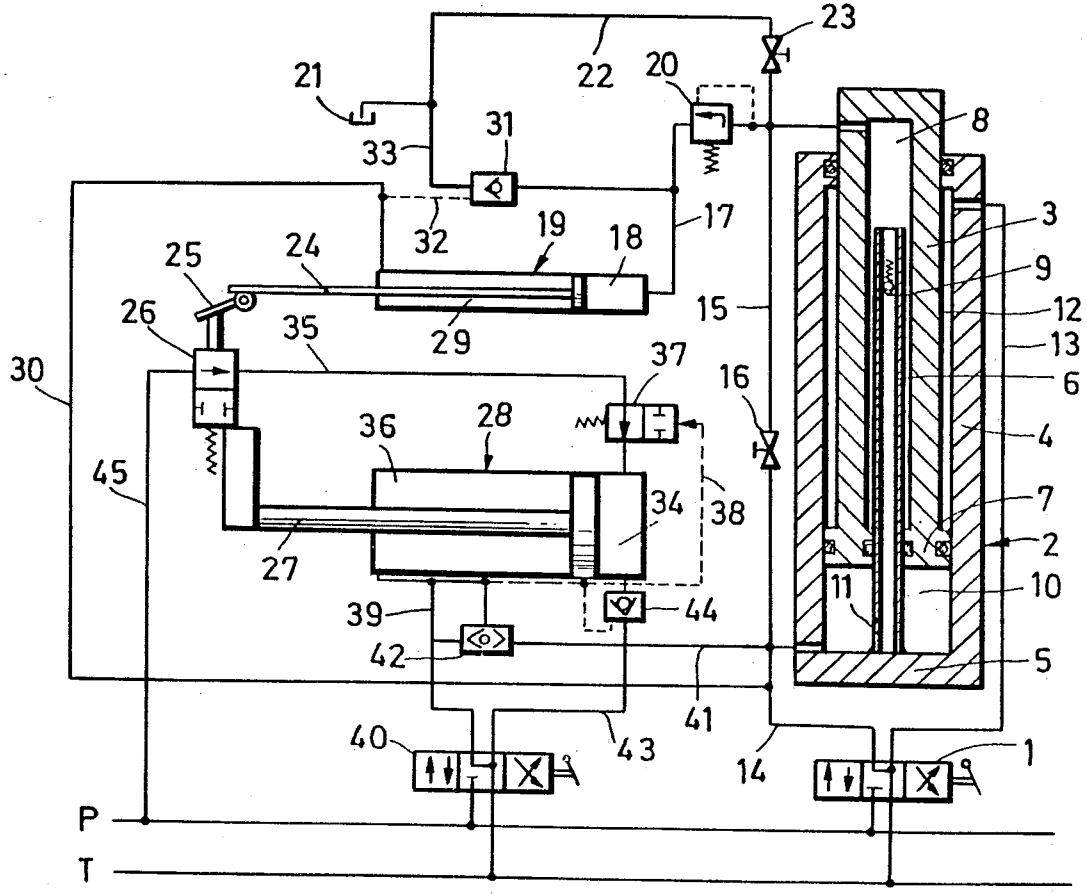
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
P
T

HYDRAULIC CONTROL ARRANGEMENT

BACKGROUND OF THE INVENTION

The present invention relates to a hydraulic control arrangement for providing a synchronization of a return cylinder between a face conveyor and a support, with a pushing cylinder which displaces a layer leading cap of the support transverse to the face wall.

In underground winning works it is always desired to support the roof immediately after its exposure by a winning tool. For this purpose leading layer caps and/or displaceable caps are used which are displaced to follow the face wall with the aid of hydraulically actuated cylinders in condition of immovably retained support, such as a powered support or a shield support. Since as a rule the winning tool is forcibly guided on the face conveyor, the face conveyor serves as a reference point for the desired displacement of the leading layer cap. When the face conveyor is displaced by a return cylinder with support against the extension of the work advance, the respective local leading layer cap must automatically follow with the same amount.

For providing the synchronism between the return cylinder which displaces the face conveyor and a pushing cylinder which displaces the leading layer cap after it, electrical or hydraulic control circuits are proposed. The electrical control circuits can be designed elegantly in the sense of control technique; however, because of the safety measures in underground winning works of space consumption it is expensive. As a result, it is not widely utilized in practice. The hydraulic control circuit possesses the disadvantage that there are several separate hydraulic columns available which are independent from one another and whose coordination in an automatic operation cannot be attained for the desired synchronism of the return cylinder and the pushing cylinder. It is necessary to provide an expensive monitoring connected with increased time-consumption and personal-consumption. Further, the operational safety can be attained seldom in a satisfactory fashion.

SUMMARY OF THE INVENTION

Accordingly, it is an object of the present invention to provide a hydraulic control arrangement of the above mentioned type, which avoids the disadvantages of the prior art.

More particularly, it is an object of the present invention to provide a hydraulic control arrangement of the above mentioned types which improves the hydraulic control so that with a simple construction the operational safety is guaranteed when a hindrance takes place on the way of the following displacement of the leading cap.

In keeping with these objects and others which will become apparent hereinafter, one feature of the present invention resides, briefly stated, in a hydraulic control arrangement for providing synchronism of a return cylinder between a face conveyor and a support, with a pushing cylinder which displaces a leading cap of the support transverse to a face, wherein a control column is provided between the return cylinder and a control cylinder influencing loading of the pushing cylinder via a control valve, and the control column is composed of a working fluid.

The important feature of the invention is the availability of only one control column formed by the hydraulic working fluid. It displaces during displacement of the return cylinder approximately in a delay-free manner and exactly the control cylinder which in turn influences, by stroke-accurate opening and closing of the control valve, the supply of the working fluid to the pushing cylinder and in this fashion guarantees the synchronization accuracy of the face conveyor and the leading cap.

Since only one control column is available, the hydraulic control can be designed sturdy and operationally safe. A low number of relatively simply designed hydraulic units are needed to provide the synchronization accuracy with different strokes of the return cylinder and of the pushing cylinder. As a result of this, the control arrangement in accordance with the present invention completely satisfies the respective requirements of the underground winning works. The proposed features are utilized both with a return cylinder which is in the so-called deflected position (loading of the greater piston surface during movement of the wall) between the wall and the face conveyor, and also in normal position. Furthermore, the control arrangement is utilized without any interference with the advantages of the shield support, supporting jacks, or walking support units of conventional design.

In accordance with the present invention it is guaranteed that the leading cap first follow the face when a pressure is formed in the return cylinder which lies above the setting pressure in the prop of the support. For this purpose, the connecting conduit between the return cylinder and the control cylinder is provided with a pressure limiting valve which is adjustable and hydraulically activatable above the setting pressure of the support. When the setting pressure amounts to approximately 320 bar, the pressure limiting valve is adjusted to approximately 360 bar. Thereby the required safety interval is guaranteed.

A further advantageous feature of the present invention is that a displacement pipe which determines the volume of the control column is mounted on the bottom of the return cylinder and extends into a hollow piston rod of the latter, wherein the displacement pipe is provided at its free end with a check valve. Such an arrangement is used particularly when the return cylinder operates in its deflected position. Prior to the movement of the face conveyor, the piston rod is extended and the fee end of the displacement pipe is located in the vicinity of the cylinder piston. The piston rod chamber is filled with working fluid.

When now, for example via a 4/3 control valve, the annular chamber of the return cylinder is loaded with the pressure fluid, the displacement pipe with the inserted piston is introduced into the piston rod chamber. The working fluid located in the latter first cannot release, since the pressure limiting valve prevents a discharge thereof. First when the pressure limiting valve attains the adjusted pressure, the hydraulic control column located in the piston rod chamber can displace with the resulting displacement of the control cylinder. Since the stroke of the return cylinder and the stroke of the pushing cylinder are fixed, the outer diameter of the displacement pipe determines the volume of the hydraulic control column.

In connection with this, a further advantageous feature of the present invention is that the ratio of the outer diameter of the displacement pipe and the piston diameter of the control cylinder is dimensioned in correspondence with the ratio of the return cylinder stroke with the pushing cylinder stroke.

It is to be understood that when a return cylinder and a pushing cylinder described here, there can be in some cases also two or more pushing cylinders or return cylinders arranged in parallel with one another.

In accordance with still another advantageous feature of the present invention, the control valve is formed as a 2/2 control valve arranged at a free end of the piston rod of the pushing cylinder and switchable by the piston rod of the control cylinder against an elastic return force into its open position. As long as the piston rod of the control cylinder is in contact with the regulating element of the 2/2 control valve, the working fluid can objectionably flow to the piston chamber of the pushing cylinder. When, however, a displacement of the return cylinder and thereby a displacement of the control column with the resulting displacement of the piston rod of the control cylinder takes place, the contact between the piston rod of the control cylinder and the regulating element of the 2/2 control valve is interrupted. The 2/2 control valve closes automatically and the displacement of the pushing cylinder is interrupted.

Still another advantageous feature of the present invention is that a 2/2 control valve is arranged in a working fluid conduit connected with the piston chamber of the pushing cylinder and is convertible to its closing position by loading of the annular chamber of the pushing cylinder against an elastic return force. This control valve operates when after exhaustion of the pushing cylinder the piston must again be moved back into its initial position. In this event it is necessary to interrupt the supply of the working fluid to the piston chamber of the pushing cylinder.

An additional feature of the present invention is that a changeover valve is arranged in a connecting conduit between the piston chamber of the return cylinder and the annular chamber of the pushing cylinder. The changeover valve is arranged in a conduit between the annular chamber of the pushing cylinder and the pushing cylinder, which communicates with a 4/3 control valve providing connection to a pressure conduit and a return conduit. Thereby, loading of the annular chamber of the pushing cylinder is guaranteed independently of whether the working fluid is supplied during automatic operstion via the return cylinder or during manual operation via the 4/3 control valve associated with the pushing cylinder. In dependence upon the desired loading of the piston chamber of the return cylinder or the annular chamber of the pushing cylinder, the 2/2 control valve incorporated in the supply to the piston chamber of the pushing cylinder obtains in each case the control pressure and closes.

For enabling the fluid to flow out of the piston chamber of the pushing cylinder unobjectionably into the return conduit, a check valve is further provided in accordance with the present invention which is arranged in a connecting conduit between the piston chamber of the pushing cylinder and the associated 4/3 control valve and is hydraulically adjustable by pressure in the annular chamber of the pushing cylinder.

During the return stroke of the control cylinder, whose annular chamber is coupled via a connecting conduit with the piston chamber of the return conduit, it is required that the piston chamber of the control conduit be connected with the return flow conduit or the tank. For this purpose, in accordance with the present invention a check valve is connected with the conduit between the adjustable pressure limiting valve and the piston chamber of the control cylinder and is hydraulically adjustable by pressure in the annular chamber of the control cylinder.

A manual pressure release of the piston rod chamber of the return cylinder is carried out in accordance with the present invention by connection of the piston rod chamber of the return cylinder via a closable ventilating conduit to the tank.

Finally, in accordance with still a further advantageous feature of the present invention, a connecting conduit is provided between the piston chamber and the piston rod chamber of the return cylinder and is openable on demand. In the connecting conduit, a shutoff member formed, for example, as a ball faucet is arranged. In normal case, that is during automatic operation, the ball faucet is closed. When the return cylinder must be operated alone, the ball faucet is opened and thereby the piston rod chamber is short-circuited with the piston chamber.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing is a view showing a hydraulic control arrangement in accordance with the present invention.

DESCRIPTION OF A PREFERRED EMBODIMENT

A hydraulic control arrangement in accordance with the present invention is used for providing a synchronism of a return cylinder between a face conveyor and a support, with a pushing cylinder which displaces a leading cap of the support transverse to the face wall.

U.S. Pat. No. 4,309,131 which is incorporated here by reference discloses such a mine roof support with a telescopable leading cap. The leading cap is displaceable by a pushing cylinder which is not shown but, however, provided in roof cap of the support. The patent shows a return device whose cylinder housing is connected at the working face end portion with the support and whose piston rod is connected at the rear end portion with the conveyor via a guiding rod arranged on the floor. In the roof support of this type it is required to provide the synchronism between the pushing cylinder which supports the leading cap and the return device which is arranged between the support and the conveyor. For this purpose, the inventive hydraulic arrangement is used.

Pressure and return conduits for a hydraulic working fluid, laid in a mine face, are identified with reference characters P and T. A conventional 4/3 control vave 1 is connected with the pressure and return conduits P and T so that the pressure fluid is supplied to a return cylinder 2 or can be withdrawn from the return cylinder 2. The return cylinder 2 connects in a not shown fashion a shield support with a face conveyor. A piston rod 3 is hollow and communicates with the support, whereas a cylinder housing 4 of the return cylinder 3 communicates with the face conveyor.

A displacement pipe 6 is mounted on a bottom 5 of the cylinder housing 4. The displacement pipe 6 extends through a piston 7 of the return cylinder 2 and extends into a piston rod chamber 8. A check valve 9 is provided at a free end of the displacement pipe 6 and closes in direction toward a piston chamber 10. The piston chamber 10 communicates with the displacement pipe 6 via a transverse opening 11.

Connecting conduits between the 4/3 control valve 1 and an annular chamber 12 of the return cylinder 2 or the piston chamber 10 are identified with reference numerals 13 and 14. As can be further seen from the drawing, the piston chamber 10 and the piston rod chamber 8 can be connected with one another directly or, so to say, short-circuited. A connecting conduit 15 is provided for this purpose and has a shutoff member formed as a ball faucet 16.

A connecting conduit 17 is connected with the piston rod chamber 8 and leads to a piston chamber 18 of a control cylinder 19. An adjustable pressure limiting valve 20 is arranged in the connecting conduit 17. Pressure release of the piston rod chamber 8 is performed by a conduit 22 which leads to a tank 21 and is provided with a shutoff member formed as a ball faucet 23.

A piston rod 24 of the control cylinder 19 can be brought into contact with a regulating element 25 of a 2/2 control valve 26 which in turn is arranged at the free end of a piston rod 27 of a pushing cylinder 28. The pushing cylinder 28 can displace a not shown leading cap associated with a shield support, in direction toward the face wall.

An annular chamber 29 of the control cylinder 19 is connected via a connecting conduit 30 with the connecting conduit 14 which communicates the 4/3 control valve 1 with the piston chamber 10 of the return cylinder 2. It can further be seen that a check valve 31 is connected with the connecting conduit 17 between the piston rod chamber 8 of the return cylinder 2 and the piston chamber 18 of the control cylinder 19. The check valve 31 is controlled by pressure in the annular chamber 29 of the control cylinder 19. The control conduit of the check valve 31 is identified with reference numeral 32. A discharge 33 of the check valve 31 opens into the tank 21.

A working fluid conduit 35 is connected with a piston chamber 34 of the pushing cylinder 28. A 2/2 control valve 37 is arranged in the working fluid conduit 35 and is convertible by loading of an annular chamber 36 of the pushing cylinder 28 into the closing position. A control conduit of the 2/2 control valve 37 is identified with reference numeral 38. It is connected with a conduit 39 which communicates the annular chamber 36 of the pushing cylinder 28 with a 4/3 control valve 40. The pushing cylinder 28 is connectable with the pressure conduit P or the return conduit T via the control valve 40.

A changeover valve 42 is arranged in a connecting conduit 41 between the piston chamber 10 of the return cylinder 2 and the annular chamber 36 of the pushing cylinder 28. The changeover valve 42 is also connected with a conduit 39 between the annular chamber 36 of the pushing cylinder 28 and the 4/3 control valve 40.

It can further be seen that a check valve 44 which is hydraulically controlled by pressure in the annular chamber 36 of the pushing cylinder 28 is arranged in a connecting conduit 43 between the pressure chamber 34 of the pushing cylinder 28 and the associated 4/3 control valve 40.

During automatic operation, the 4/3 control valve 40 associated with the pushing cylinder 28 is located in the shown neutral position. When the face conveyor is pushed in correspondence with the face advance, the 4/3 valve 1 of the return cylinder 2 is turned into a position in which the pressure conduit P is connected with the annular chamber 12 and the return conduit T is connected with the piston chamber 10. Thereby the piston 7 is displaced into the cylinder housing 4. As a result of this, the displacement pipe 6 is displaced into the piston rod chamber 8 and increases the pressure in the latter. When the pressure limiting valve 20 reaches the adjusted opening pressure, which as a rule is higher than the setting pressure of the support, the control column composed of the hydraulic working fluid is displaced from the piston rod chamber for so long as the return cylinder 2 is loaded. This means that the piston rod 24 of the control cylinder 19 and the regulating unit 25 of the 2/2 control valve 26 are loaded so that the pressure fluid can flow via the conduit 45, the 2/2 control valve 26, the working fluid conduit 35 and also the 2/2 control valve 37 which opens because of the spring force, into the piston chamber 34 of the pushing cylinder 28. The pushing cylinder 28 displaces out with a stroke corresponding to the stroke of the return cylinder 2. In this manner, an absolute synchronism between the return cylinder 2 and the pushing cylinder 28 is provided. The leading layer cap can thereby be always held on the face wall.

The working fluid located in the piston chamber 10 of the return cylinder 2 flows via the conduit 14 into the return conduit T, and the working fluid located in the annular chamber 36 of the pushing cylinder 28 flows via the conduit 39 also into the return conduit T.

The above mentioned cooperation between the return cylinder 2 and the pushing cylinder 28 can be carried out so long as the stroke of the return cylinder 2 permits. For this purpose, the ratio of the outer diameter of the displacement pipe 6 to the piston diameter of the control cylinder 19 is dimensioned in correspondence with the ratio of the return cylinder stroke to the pushing cylinder stroke.

When now the support is pulled up, the 4/3 control valve 1 is switched. Now, the piston chamber 10 communicates with the pressure conduit P, and the annular chamber 12 communicates with the return conduit T. Since also the conduit 30 which leads to the annular chamber 29 of the control cylinder 19 is under pressure, both the connecting conduit 17 connected with the check valve 31 via the control conduit 32 and also the check valve 44 connected with the piston chamber 34 of the pushing cylinder 28 are opened. The pressure fluid from the piston chamber 18 of the control cylinder 19 and the piston chamber 34 of the pushing cylinder 28 can discharge into the return conduit T and to the tank 21. Simultaneously, because of the pressure in the annular chamber 36 of the pushing cylinder 28, the control conduit 38 of the 2/2 control valve 37 is loaded so that the 2/2 control valve 37 is switched into the closing position.

Because of the incorporation of the changeover valve 42, also during loading of the piston chamber 10 of the return cylinder 2, the annular chamber 36 of the pushing cylinder 28 is loaded and provides thereby for the required pressure for opening of the check valve 44 or closing the 2/2 control valve 37.

The valve 40 serves for action on the pushing cylinder 20 during the manual operation, in the shown central position for securing the automatic operation described hereinbelow during displacement of the leading cap and for bringing back the mine roof support during automatic operation.

When for example during manual operation the annular chamber 36 of the pushing cylinder 28 is loaded, the valve 40 is displaced to the right end position. In this end position the pressure conduit P is connected via the conduit 39 with the annular chamber 36, whereas the piston chamber 34 is connected via the conduit 43 with the tank T. For flowing the pressure fluids from the chamber 34 in direction to the tank T, the control conduit of the return valve 44 which is shown in solid line but not provided with reference numeral is controlled because of the pressure in the annular chamber 36.

For acting upon the piston chamber 34 of the pushing cylinder 25, the valve 40 moves to its left end position. In this position the pressure conduit P is connected via the conduit 43 with the piston chamber 34 and the tank T via the conduit 39 with the annular chamber 36.

During automatic operation and displacement of the leading cap in direction to the mine face, the valve 40 is brought in the shown central position in which both the annular chamber 36 and the piston chamber 34 are connected with the tank T. Since however the piston rod 27 is connected with the displacing leading cap, care should be taken during the action upon the piston chamber 34 that there be no pressure fluid discharged. This is provided by the integration of the return valve 44.

The check valve 44 has the purpose to make possible the discharge of the pressure fluid from the piston chamber 34 via the conduit 43 to the tank T when the support must be brought up, or in other words when the forwardly extended leading cap must be moved in the roof cap during the advancement of the support. In this case the piston rod 27 of the pushing cylinder 28, connected with the leading cap must move to the right. The annular chamber 36 is loaded with the pressure fluid and the pressure fluid must flow out into the piston chamber 34.

In this operative position the 4/3 valve 1 is located in its right end position. The conduit 13 is connected with the pressure conduit P. Also, via the conduit 41 the pressure takes place in the change over switch 42. It is displaced to the left. Thereby, on the one hand, the pressure fluid can flow into the annular chamber 36, and on the other hand the check valve 44 opens and displaces the 2/2 control 37 to the left to the closing position, so that no pressure fluid can flow from the conduits 35 via the 2/2 valve 37 into the position chamber 34.

The pressurized fluid supplied to the chamber 36 is prevented from draining the exhaust by way of line 39 and valve 40. Since during the pulling (bringing up) of the support the automatic operation is terminated, with switching of the 4/3 valve 1 to the right end position also the 4/3 valve 40 is switched to the right end position. In this position the annular chamber 36 is separated from the return conduit leading to the tank T.

It will be understood that each of the elements described above, or two or more together, may also find a useful application in other types of constructions differing from the types described above.

While the invention has been illustrated and described as embodied in a hydraulic control arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic control arrangement for providing synchronism of a return cylinder having a hollow piston rod and a bottom and arranged between a face conveyor and a support, with a pushing cylinder which displaces a leading cap of the support transverse to a face, the hydraulic arrangement comprising a control valve;

a control cylinder controlling loading of the pushing cylinder via said control valve;

a connecting conduit between the return cylinder and said control cylinder and having a pressure limiting valve provided in said connecting conduit, said pressure limiting valve being adjustable above a setting pressure of the support and hydraulically controllable;

a control column provided between the return cylinder and said control cylinder and composed of a working fluid; and a displacement pipe mounted on the bottom of the return cylinder, extending into the hollow piston rod and determining the volume of said control column, said displacement pipe being provided at its free end with a check valve.

2. A hydraulic arrangement as defined in claim 1, wherein the return cylinder and said pushing cylinder have strokes in a predetermined ratio relative to one another, an outer diameter of said displacement pipe and a piston diameter of said control cylinder being dimensioned with a ratio corresponding to the ratio of the strokes of the return cylinder and said pushing cylinder.

3. A hydraulic arrangement as defined in claim 1, wherein said pushing cylinder and said control cylinder each has a piston rod, said control valve being formed as a 2/2 control valve arranged at a free end of said piston rod of said pushing cylinder and switchable by said piston rod of said control cylinder against an elastic return force to an open position.

4. A hydraulic arrangement as defined in claim 1, wherein said pushing cylinder has a piston chamber and an annular chamber; and further comprising a working fluid conduit connected with said piston chamber of said pushing cylinder, and 2/2 control valve convertible to a closed position during loading of said annular chamber of said pushing cylinder against an elastic return force.

5. A hydraulic arrangement as defined in claim 1, wherein the return cylinder has a piston chamber and said pushing cylinder has an annular chamber; and further comprising a pressure conduit and a return conduit, a 4/3 control valve providing communication with said pressure and return conduits, a first conduit extending between said pushing cylinder and said annular chamber of said pushing cylinder and connected with said 4/3 control valve, and a connecting conduit extending between the piston chamber of the return cylinder and said annular chamber of said pushing cylinder and connected with said first conduit.

6. A hydraulic arrangement as defined in claim 5; and further comprising a further connecting conduit extending between the piston chamber of the return cylinder and said 4/3 control valve, and a check valve arranged in said further connecting conduit and hydraulically actuated by pressure in said annular chamber of said pushing cylinder.

7. A hydraulic arrangement as defined in claim 1, wherein said control cylinder has a piston chamber and an annular chamber; and further comprising a conduit extending between said adjustable pressure limiting valve and said piston chamber of said control cylinder, and a check valve arranged in said conduit and hydraulically adjustable by pressure in said annular chamber of said control cylinder.

8. A hydraulic arrangement as defined in claim 1, wherein the return cylinder has a piston rod chamber; and further comprising a tank, and a closable pressure release conduit communicating said piston rod chamber of said return cylinder with said tank.

9. A hydraulic arrangement as defined in claim 1, wherein the return cylinder has a piston chamber and a piston chamber; and further comprising a connecting conduit extending between the piston chamber and the piston rod chamber and openable on demand.

* * * * *